US010314351B2

(12) United States Patent
Stevenson

(10) Patent No.: US 10,314,351 B2
(45) Date of Patent: Jun. 11, 2019

(54) ATHLETIC HEADBAND WITH REMOVABLE COOLING ELEMENTS

(71) Applicant: Thermonator, Inc., Louisville, KY (US)

(72) Inventor: Kevin Foster Stevenson, Louisville, KY (US)

(73) Assignee: Thermonator, Inc., Louisville, KY (US)

( * ) Notice: Subject to any disclaimer, the term of this patent is extended or adjusted under 35 U.S.C. 154(b) by 0 days.

(21) Appl. No.: 16/032,583

(22) Filed: Jul. 11, 2018

(65) Prior Publication Data

US 2018/0317579 A1 Nov. 8, 2018

Related U.S. Application Data

(63) Continuation of application No. 14/831,447, filed on Aug. 20, 2015, now Pat. No. 10,021,926.

(60) Provisional application No. 62/042,974, filed on Aug. 28, 2014.

(51) Int. Cl.
*A41D 20/00* (2006.01)
*A42B 1/00* (2006.01)

(52) U.S. Cl.
CPC ..... *A41D 20/005* (2013.01); *A42B 1/008* (2013.01)

(58) Field of Classification Search
CPC ..... A41D 20/005; A41B 1/008
See application file for complete search history.

(56) References Cited

U.S. PATENT DOCUMENTS 683,991 A * 10/1901 Rowe ..... 607/110
1,169,123 A * 1/1916 Burns ..... 607/110
1,567,931 A * 12/1925 Epler ..... A61F 7/02 128/DIG. 23
2,049,723 A * 8/1936 Pomeranz ..... A61F 7/103 2/7
2,158,571 A * 5/1939 Culp ..... A42B 1/008 2/7
3,159,160 A * 12/1964 Ullom ..... A61F 7/02 128/97.1
3,491,761 A * 1/1970 Baker ..... A61F 7/10 383/901
3,696,814 A * 10/1972 Umemoto ..... A61F 7/10 607/110
4,204,543 A * 5/1980 Henderson ..... A41D 13/0055 2/171.2

(Continued)

*Primary Examiner* — Richale L Quinn
(74) *Attorney, Agent, or Firm* — Hoffmann & Baron, LLP

(57) ABSTRACT

Provided is an athletic headband with removable cooling elements. The headband includes a body, first cooling elements, dropdown pocket, and second cooling element. The body has first and second openings. The body includes pockets disposed about the body between the first and second openings. The pockets have respective openings. The first cooling elements are configured to be received into the pockets through the respective openings to provide cooling about the head of the user. The dropdown pocket is secured to an interior of the body, extends below the body, and has an opening. The second cooling element is received into the dropdown pocket through the opening, wherein a first cooling element in a pocket of the body overlaps at least partially the second cooling element in the dropdown pocket and is configured to press the second cooling element into the neck of the user to provide cooling to the neck.

20 Claims, 4 Drawing Sheets

(56) References Cited

U.S. PATENT DOCUMENTS 4,484,363 A * 11/1984 Varanese ..... A42B 1/008 2/181
4,552,149 A * 11/1985 Tatsuki ..... A42B 1/008 607/110
4,815,144 A 3/1989 Martin
4,934,357 A * 6/1990 Frantzich ..... A61F 13/122 602/61
5,005,374 A * 4/1991 Spitler ..... A41D 13/0055 2/171.2
5,109,841 A * 5/1992 Hubbard ..... A61F 7/103 128/897
5,119,513 A * 6/1992 McKay ..... A41D 20/005 2/170
5,274,865 A * 1/1994 Takehashi ..... A47G 9/1036 5/421
5,305,470 A * 4/1994 McKay ..... A41D 20/005 2/170
5,365,607 A * 11/1994 Benevento, Jr. ..... A42B 1/008 2/171.1
5,395,400 A * 3/1995 Stafford ..... A42B 1/008 2/209
5,400,617 A * 3/1995 Ragonesi ..... A61F 7/10 165/10
5,469,579 A 11/1995 Tremblay et al.
5,539,934 A 7/1996 Ponder
5,572,745 A 11/1996 Mainus
5,605,144 A * 2/1997 Simmons ..... A41D 13/0051 126/204
5,897,582 A * 4/1999 Agnatovech ..... A61F 7/10 607/109
5,957,964 A * 9/1999 Ceravolo ..... A61F 7/10 607/109
D417,282 S * 11/1999 Allen ..... D2/880
6,185,750 B1 * 2/2001 Dumas ..... A41D 13/0055 2/171.2
6,537,308 B2 * 3/2003 Burkhart ..... A61F 7/02 2/171.2
6,554,787 B1 * 4/2003 Griffin ..... A61F 7/02 601/70
6,557,179 B1 * 5/2003 Reuven ..... A42B 1/008 2/171.2
6,681,590 B1 1/2004 Jones
6,857,134 B1 * 2/2005 Cowell ..... A42C 5/04 2/209.13
7,096,510 B2 * 8/2006 Yeadon ..... A42B 1/041 2/202
D529,617 S 10/2006 Fontanez Acevedo
D591,030 S 4/2009 Lacey
7,921,473 B1 4/2011 Winters
8,262,601 B2 * 9/2012 Cumming ..... A61F 13/12 2/171
8,418,269 B1 4/2013 McBride
9,149,393 B2 * 10/2015 Cumming ..... A61F 13/12
9,247,778 B2 * 2/2016 Cleva ..... A42B 3/127
2002/0035745 A1 * 3/2002 Spell ..... A42B 1/008 2/209.13
2002/0100106 A1 8/2002 Simmons
2005/0034215 A1 * 2/2005 Harrison ..... A42B 1/008 2/207
2006/0005291 A1 1/2006 Bedford
2007/0250138 A1 10/2007 Nofzinger
2009/0299259 A1 12/2009 Cumming et al.
2010/0037366 A1 2/2010 Panicali
2010/0331752 A1 * 12/2010 Cumming ..... A61F 13/12 602/74
2012/0073031 A1 * 3/2012 Horwitz ..... A42B 1/008 2/209.13
2012/0296252 A1 11/2012 Cumming et al.
2013/0042395 A1 2/2013 Litterini
2013/0152274 A1 * 6/2013 Welch ..... A42B 1/008 2/171.2
2015/0297397 A1 * 10/2015 Rand ..... A61F 7/106 607/110
2015/0342279 A1 * 12/2015 Haggard ..... A42B 1/008 2/171.2
2016/0128411 A1 * 5/2016 Ayres ..... A42B 1/241 2/172

* cited by examiner

ATHLETIC HEADBAND WITH REMOVABLE COOLING ELEMENTS

CROSS REFERENCE TO RELATED APPLICATIONS

This application is a continuation of U.S. patent application Ser. No. 14/831,447, filed on Aug. 20, 2015, which claims priority to and benefit of U.S. Provisional Patent Application No. 62/042,974, filed on Aug. 28, 2014, the contents of which are incorporated herein by reference in their entirety.

BACKGROUND

Field

The present application relates to headbands. More specifically, the present application is directed to an athletic headband with removable cooling elements.

Brief Discussion of Related Art

Intensity of exercise as well as ambient temperature/humidity can affect core body temperature, which can elevate with increased intensity as well as with increased temperature/humidity. The body's natural response is perspiring or sweating, which generally releases excess heat through the skin surface in order to cool the body.

The hypothalamus is a portion of the human brain, which is located just above the brainstem. The hypothalamus functions as a thermostat for the body. More specifically, the hypothalamus includes a number of nuclei with a variety of functions, including an anterior hypothalamic nucleus that is responsible for thermoregulation or cooling of the body. The anterior hypothalamic nucleus sets desired body temperature, such as stimulating heat production to raise blood temperature to a higher setting, or sweating to lower the blood temperature to a lower setting.

Athletic headbands come in a variety of shapes and sizes, and generally absorb and/or draw away perspiration from the body of the user during various athletic activities, which may to an extent alleviate the user's discomfort—but which does not necessarily cool the user—and thus may not provide sufficient alleviation of the user's discomfort, especially during intense exercise and/or high ambient temperature/humidity.

The head and neck are generally more sensitive to changes in body temperature than the rest of the body. Providing cooling to the head and neck (e.g., hypothalamic cooling) can provide improved cooling of the body and thus improve user's comfort, especially during and/or after intense exercise.

It is therefore desirable to provide an athletic headband that can improve cooling and comfort of the user especially during and/or after engagement in various athletic activities.

SUMMARY

In accordance with an embodiment, an athletic headband is disclosed. The athletic headband includes a body, a plurality of first cooling elements, a dropdown pocket, and a second cooling element.

The body has a first opening and a second opening that is substantially opposed to the first opening. Further, the body is configured to fit a head of a user through the first opening. Also, the body includes a plurality of pockets disposed about the body between the first opening and the second opening. The plurality of pockets has a respective plurality of openings.

The plurality of first cooling elements is configured to be received into the plurality of pockets through the respective plurality of openings to provide cooling about the head of the user.

The dropdown pocket is secured to an interior of the body between the first opening and the second opening. Further, the dropdown pocket extends from the interior of the body below the body and has an opening.

The second cooling element is configured to be received into the dropdown pocket through the opening. A first cooling element to be received in a pocket of the body overlaps at least partially the second cooling element to be received in the dropdown pocket so that the first cooling element is configured to press the second cooling element into a neck of the user to provide cooling to the neck.

In some embodiments or aspects, the body can be stretchable. Moreover, a pocket of the plurality of pockets can be defined by side stitchings that extend between about the first opening and about the second opening. The pocket can also include a retaining device to releaseably close the pocket.

In some embodiments or aspects, a cooling element of the plurality of first cooling elements can include a shell and a fill material, wherein the fill material is enabled to provide cooling to the user. The fill material can be a gel, gel-filled beads, or water, which can be cooled or frozen to provide cooling. Furthermore, the fill material can include components capable of providing cooling via an endothermic reaction.

The plurality of first cooling elements can be disposed adjacently one another about the body, and can further provide continuous cooling about the head of the user. Moreover, the second cooling element can be approximately the same as the first cooling element, or larger than the first cooling element.

A pocket of the plurality of pockets can include an opening about the second opening of the body. Moreover, the opening of the dropdown pocket can further be between the first opening and the second opening of the body.

In some embodiments or aspects, the dropdown pocket can be stitched to the body generally along stitchings that define a pocket of the plurality of pockets in the body. Moreover, the dropdown pocket can have a generally arcuate bottom. Additionally, the dropdown pocket can be stretchable. The dropdown pocket can also include a retaining device to releaseably close the dropdown pocket.

The second cooling element includes a shell and a fill material, wherein the fill material is enabled to provide cooling to the user. The fill material can be a gel, gel-filled beads, or water, which can be cooled or frozen to provide cooling. Furthermore, the fill material can include components capable of providing cooling via an endothermic reaction.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which.

DETAILED DESCRIPTION

An athletic headband to improve cooling and comfort of the user is disclosed herein. In the following description, for the purposes of explanation, numerous specific details are set forth in order to provide a thorough understanding of example embodiments. It will be evident, however, to one skilled in the art, that an example embodiment may be practiced without all of the disclosed specific details.

Figure 1:
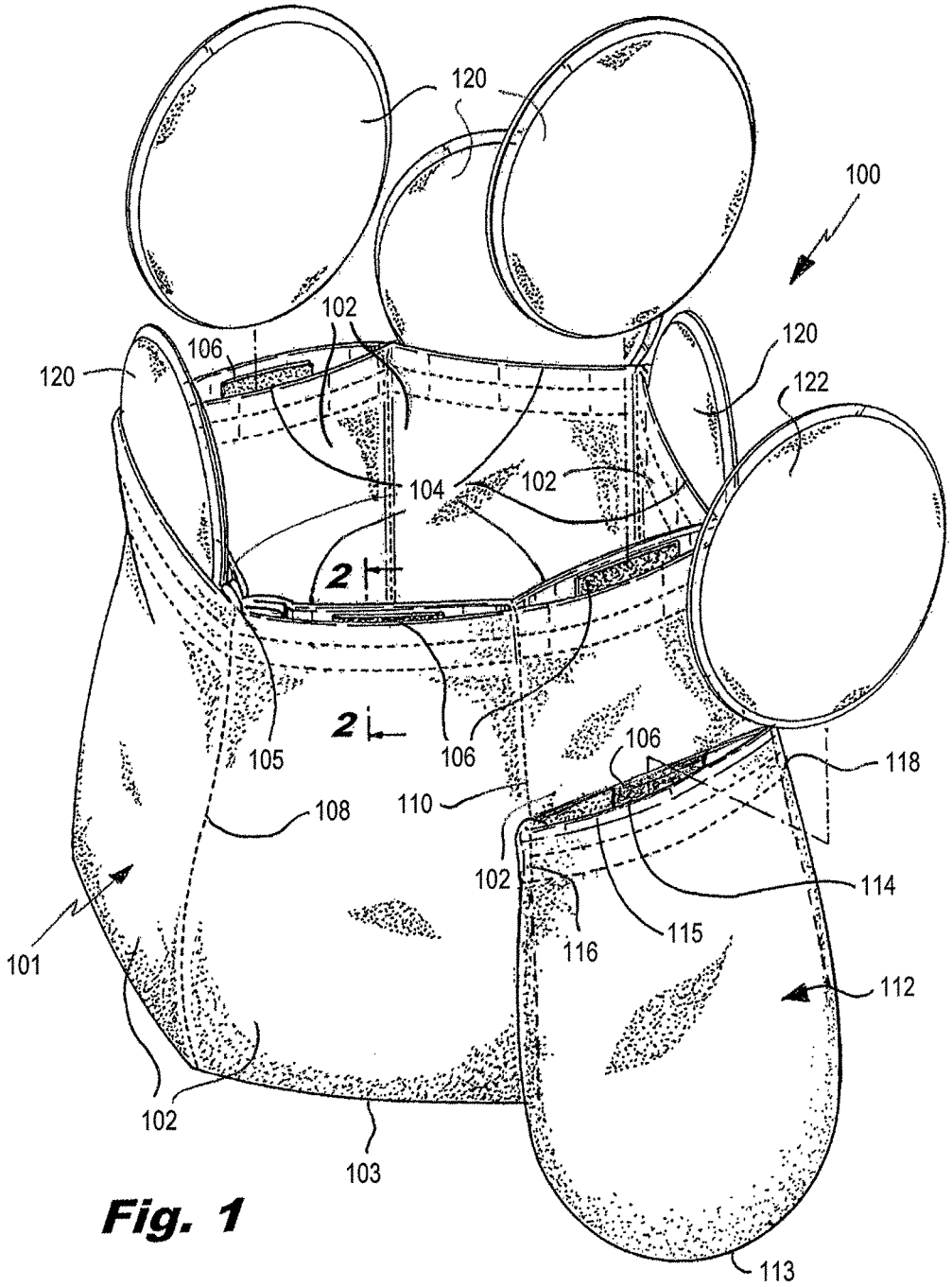
FIG. 1 illustrates a perspective view of an example athletic headband with removable cooling elements according to a first example embodiment.

FIG. 1 illustrates a perspective view of an example athletic headband 100 with removable cooling elements 120, 122 according to a first example embodiment. The athletic headband 100 is shown inside out in order to illustrate its construction.

The athletic headband 100 is configured to provide a combination of cooling and comfort. More specifically, the athletic headband 100 provides removable cooling elements 120, 122 for cooling the head and neck of the user, as well as stretchability (e.g., top-to-bottom and circumferentially) for disposing the headband 100 atop the head of the user and for holding the cooling elements to provide improved use and comfort to the user. Moreover, the athletic headband 100 is configured to fit precisely over a user's head, providing effective cooling to the user during and/or after athletic activity in which the user engages. The cooling reduces overheating and decreases the likelihood of heat stress and/or heatstroke, which can result from exercise and/or ambient temperature/humidity.

The athletic headband 100 includes a body 101, a drop-down pocket 112, and a plurality of insertable and/or removable cooling elements 120, 122. The body 101 can be made from synthetic and/or manmade materials, natural materials, and/or blended combinations thereof, such as, for example, acrylic, nylon, spandex, cotton, other natural or synthetic materials, and combinations thereof can be used. In some embodiments, the body 101 can be made of a combination of nylon and spandex. These materials provide excellent stretchability for wearing the athletic headband 100 and conforming the athletic headband 100 (as well as the cooling elements 120, 122 therein) to the head of the user. In these or other embodiments, at least the interior side (or layer) of the body 101 can also incorporate a material, or a combination of materials (e.g., cotton or a cotton blend), which can absorb and/or draw away perspiration from the head of the user during and/or after various athletic activities.

The body 101 is configured to receive and retain a plurality of cooling elements 120 in a predetermined configuration which provides cooling during operation of the athletic headband 100, i.e., when the user wears the athletic headband 100 on the user's head. More specifically, the body 101 includes a plurality of pockets 102, each of which is configured (e.g., sized and dimensioned) to receive and retain a respective cooling element 120, such that the plurality of cooling elements 120 can be disposed in a predetermined configuration about the circumference of the headband 100. In some embodiments, six (6) pockets 102 are provided in the body 101. In alternate embodiments, the body 101 can be provided with fewer or greater number of pockets 102.

The pockets 102 are disposed adjacently about the body 101 such that the cooling elements 120 can be disposed adjacently to one other, providing for continuous cooling about the circumference of the athletic headband 100. In some embodiments, the pockets 102 can be disposed approximately equidistantly about the body 101. In other embodiments, the pockets 102 can be disposed at locations not disposed equidistantly about the body 101, e.g., based on the size and dimension of the respective cooling element 120 to be retained in the respective pockets 102.

Figure 2:
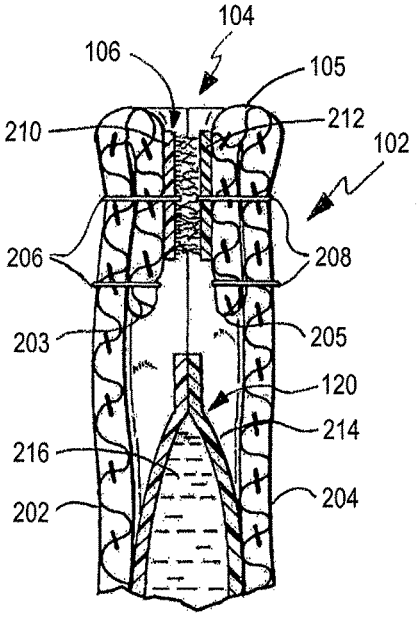
FIG. 2 illustrates a cross-sectional view of the example athletic headband illustrated in FIG. 1, with a cooling element disposed in a pocket of the athletic headband.

The body 101 can be constructed from one piece of material, which is folded lengthwise to form exterior and interior sides (or layers) and a base 103, or two similarly-sized but separate pieces of material stitched together lengthwise and turned inside out with the stitching to the interior in order to form exterior and interior sides (or layers) and the base 103. Moreover, a top 105 can be formed by providing hems folded to the interior and stitched by one or more stitchings, as illustrated in FIG. 2. One or more of the left/right edges of the material can be cut an angle from the bottom to the top, such that a top circumference of the body 101 is smaller than a bottom circumference of the body 101 when the edges are stitched together top-to-bottom in order to form the body 101.

In some embodiments, the top circumference can be approximately 15 inches, and the bottom circumference can be about 18 inches. The body 101 is generally open and round, taking on a slightly tapered appearance which transitions smoothly between the circumferences. This configuration helps in retaining the athletic headband 100 on the user's head and in compressing the cooling elements 120, 122 to deliver effective cooling to the user's head and neck. The top-to-bottom height of the body 101 can be approximately four and three quarter (4¾%) inches. It should be noted that different top and bottom circumferences as well as height of the body 101 can be provided based on requirements for the head size of the user, such as by using differently dimensioned material and the angulation at the edges.

A pair of side stitchings 108, 110 defines each of the respective pockets 102 in the body 101. In some embodiments, the pockets 102 are of approximately equal dimensions. Furthermore, the side stitchings 108, 110 of each pocket 102 extend from approximately the base 103 and along the height of the body 101 to approximately the top 105 of the body 101. In other embodiments, a different number of pockets 102, of equal or different dimensions, can be provided by disposing the side stitchings 108, 110 at different distances from one another.

In addition, the pockets 102 include openings 104 and retaining devices 106. The openings 104 of the respective pockets 102 are defined by the side stitchings 108, 110, and are stretchable in order to receive the cooling elements 120 into the respective pockets 102. The length of the opening 104 to the pocket 102 is approximately two and one half (2½) inches, while a length of the bottom of the pocket 102 is approximately three (3) inches. It should be noted that the pockets 102 and/or openings 104 having different dimensions can be provided based on various requirements.

As illustrated in FIG. 1, the retaining devices 106 are hook-and-loop, which can releaseably close the pockets 102. It should be noted that different retaining devices can be provided to releaseably close the pockets 102. In some embodiments, the retaining devices 106 can also be omitted.

As further illustrated in FIG. 1, the athletic headband 100 includes a dropdown pocket 112. The dropdown pocket 112 can be made of a material that is similar to or different than the material of the body 101, as described hereinabove with respect to the body 101. The dropdown pocket 112 can be constructed of two (2) similarly-sized pieces of material which have an arcuate (semi-circular) bottom edge, which when stitched together and turned inside out, form the dropdown pocket 112 that has an arcuate (e.g., semi-circular) base 113. Moreover, the top 115 can be formed by providing hems folded to the interior and stitched by one or more stitchings, in a similar fashion as illustrated with respect to the body 101 in FIG. 2.

In some embodiments, the dropdown pocket 112 can be made of a combination of nylon and spandex. Stretchable materials are excellent for receiving the cooling element 122 in the dropdown pocket 112 and conforming the athletic headband 100 (as well as the cooling elements 120, 122 therein) to the head and neck of the user. In these or other embodiments, at least the interior side (or layer) of the dropdown pocket 112 can also incorporate a material, or a combination of materials (e.g., cotton or a cotton blend), which can absorb and/or draw away perspiration from the neck of the user during and/or after various athletic activities.

The dropdown pocket is stitched to the body 101 approximately half-way down the pocket 102 (e.g., two (2) inches below the top 105) by the side stitchings 116, 118. The opening 114 of the dropdown pocket 112 is approximately two and one half (2½) inches, and the base 113 is defined by a circle having a diameter of approximately two inches. The height of the dropdown pocket 112—from the lowest point of the base 113 to the top 115—is approximately 4 and one half (4½) inches. Different dimensions can be selected for the dimensions and the location of the dropdown pocket 112 in relation to the body 101.

Six (6) cooling elements 120 and one (1) cooling element 122 are insertable into the respective pockets 102, 112. In various embodiments, there can be fewer or greater number of cooling elements 120 based on the number of pockets 102. As illustrated in FIG. 1, the cooling elements 120, 122 are generally round. However, the cooling elements 120, 122 can also be any shape or a combination of shapes, such as generally rectangular or square (with rounded corners), elliptical, another shape, or combination of shapes. In some embodiments, the cooling element 122 can be dimensioned to be larger than cooling element 120. In other embodiments, the cooling elements 120, 122 can also be dimensioned to be the same or similar.

In some embodiments, the cooling elements 120, 122 are gel packs, which can be cooled/frozen but remain flexible, in order to conform to the head of the user during operation of the athletic headband 100. Different cooling elements can be used, such as described hereinbelow in greater detail with reference to FIG. 2.

The cooling elements 120 are independently situated or disposed in the respective pockets 102 of the body 101, providing almost continuous cooling about the circumference of the athletic headband 100. Moreover, the cooling element 122 is disposed in the dropdown pocket 112 such that the cooling element 120 at least partially overlaps the cooling element 122, providing almost continuous cooling that extends from the body 101 down the dropdown pocket 112. The cooling elements 120, 122 are flexible and can conform to the pockets 102, 112 as well as to the user's head and neck. In some embodiments, the cooling elements 120 are approximately three and one half (3½)inches in diameter (or width), while the cooling element 122 is approximately four (4) inches in diameter (or width). In other embodiments, the cooling elements 120, 122 are the same in size, e.g., three and one half (3½)inches diameter or width.

As described hereinabove, the cooling element 122 in the dropdown pocket 112 can be larger than the cooling element 120 in the other pockets 102. This is done so that the cooling elements 120, 122 can at least partially overlap in the proximity of the hypothalamus at the base of the head. In other embodiments, the location of dropdown pocket 112 can be adjusted with respect to the pocket 102, such that similarly sized cooling elements 120, 122 (e.g., three and one half (3½) inches) can at least partially overlap in the proximity of the hypothalamus at the base of the head. As aforementioned, one of the functions of the hypothalamus is to regulate body temperature. By overlapping cooling elements 120, 122, the cooling effect in proximity of the hypothalamus is enhanced. Also, the dropdown pocket 112 extends down the neck approximately two (2) inches, which provides additional cooling effect and comfort to the user. The cooling effect works properly when the cooling elements are cold and/or frozen.

The base 103 extends along the circumference of the body 101 to provide a seat for each of the cooling elements 120, while the arcuate base 113 extends along the bottom of the dropdown pocket 112 to provide a seat for the cooling elements 122, such that the cooling elements 120, 122 can be retained in a predetermined configuration with respect to one another and can provide an almost continuous cooling to the head and neck of the user during use of the athletic headband 100.

FIG. 2 illustrates a cross-sectional view along line 2-2 of the example athletic headband 100 illustrated in FIG. 1, with a cooling element 120 disposed in a pocket 102 of the athletic headband 100.

As illustrated, the top 105 of the body 101 is formed by sides or layers 202, 204 of the material folded to the interior of the body 101 and stitched by respective stitchings 206, 208 to provide hems 203, 205. Moreover, the same stitchings 206, 208 can be used to secure the respective portions 210, 212 of the retaining device 106 (e.g., hook-and-loop) to the hems 203, 205.

The cooling element 120 is disposed in the pocket 102 and abuts the base 103 (not shown). Moreover, the retaining device 106 can be releaseably closed to secure the cooling element 120 in the pocket 102. As noted herein, the retaining device 106 can be omitted, in which case, the smaller top circumference of the body 101 retains the cooling element 120 in the pocket 102.

The retention before deployment of the athletic headband 100 on the head of the user can be accomplished without the retaining devices 106 because the height of the athletic headband 100 allows the cooling element 120 to be disposed at a distance (e.g., approximately one and a quarter (1¼) inches) from the opening 104 of the pocket 102. Moreover, the opening 104 of the pocket 102 (e.g., 2½ inches) is smaller than the diameter (or width) of the cooling element 120 (e.g., 3½ inches).

During deployment of the athletic headband 100 on the head of the user, the retention can be accomplished due to conformity of the athletic headband 100 to the contour of the user's head. The contour conformity is generally created by the smaller top circumference (e.g., 15 inches) and larger bottom circumference (e.g., 18 inches).

It should be noted that retention before deployment can also be enhanced with the retaining device 106. The retaining device 106 can further prevent the cooling element 120 from coming out of the pocket 104 when the athletic headband 100 is tossed to the ground or elsewhere.

The cooling element 120 includes a flexible shell 214 and a fill material 216. The cooling elements 120 can be reusable or single use. In the reusable case, the fill material 216 can be cooled (and re-cooled) by refrigeration, such as gel, gel-filled beads, water, a different material, or a combination of materials. Gel may be preferable as it tends to be flexible when cold and can conform to the user's head during operation of the athletic headband 100. In some embodiments where water is used, the shell 214 can be placed on a contoured surface when the water is cooled and/or frozen, such that shell 214 can better conform to the head of the user. In other embodiments, the shell 214 is generally flat when water is cooled and/or frozen. In single use cases, the fill material 216 can be also comprised of separate components (not shown) that, when combined, create cold via an endothermic reaction.

While the dropdown pocket 112 is not illustrated in FIG. 2, the top 115 of the dropdown pocket 112 can be formed in the same fashion as described with reference to the top 105 of the body 101. More specifically, the top 115 of the pocket 112 can be formed by sides of the material folded to the interior of the pocket and stitched by respective stitchings to provide hems. Moreover, the same stitchings can be used to secure respective portions of the retaining device 106 (e.g., hook-and-loop) to the hems. Moreover, while the cooling element 122 is not illustrated in FIG. 2, the cooling element 122 is disposed in the pocket 112 in a similar fashion, abutting the base 113 (not shown). Similarly, the retaining device 106 can be provided or omitted, as desired. Moreover, the cooling element 122 can be similar to or different than cooling element 120, as described hereinabove.

Figure 3:
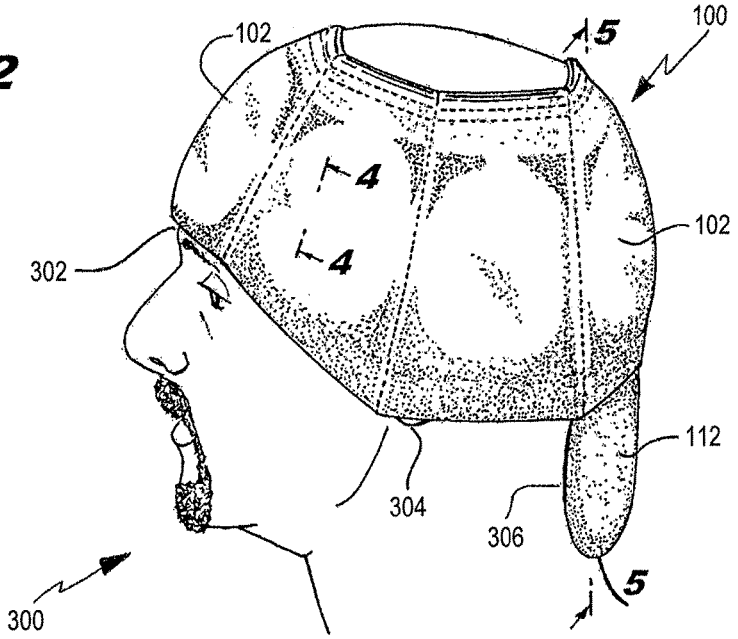
FIG. 3 illustrates a user wearing the example athletic headband illustrated in FIG. 1.

FIG. 3 illustrates a user wearing the example athletic headband 100 illustrated in FIG. 1.

As illustrated in FIG. 3, because the athletic headband 100 is stretchable (e.g., top-to-bottom and circumferentially), it can be pulled down over the forehead 302 and the ears 304, and down the neck 306, which thereby positions the cooling elements 120 disposed in the pockets 102 about the head of the user 300, and further positions the cooling element 122 disposed in the pocket 112 about the neck 306 of the user 300.

The cooling elements 120, 122 are retained in the athletic headband 100, in pockets 102, 112 and generally conform to the head and neck of the user 300, providing an almost continuous cooling to the user's head and neck.

Figure 4:
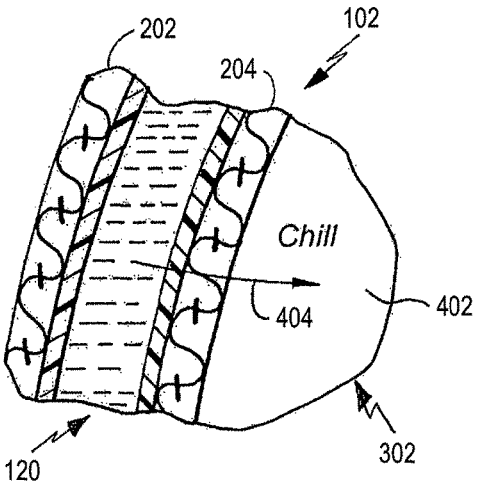
FIG. 4 illustrates an exploded cross-sectional view of the example athletic headband illustrated in FIG. 3, providing cooling to a portion of the user's head.

FIG. 4 illustrates an exploded cross-sectional view along line 4-4 of the example athletic headband 100 illustrated in FIG. 3, providing cooling to a portion 402 of the user's head.

As illustrated, the cooling element 120 is retained in the pocket 102 of the athletic headband 100 and generally conforms to a portion 402 of the head of the user 300. Moreover, the cooling element 120 provides cooling 404 to the portion 402 of the user's head.

Figure 5:
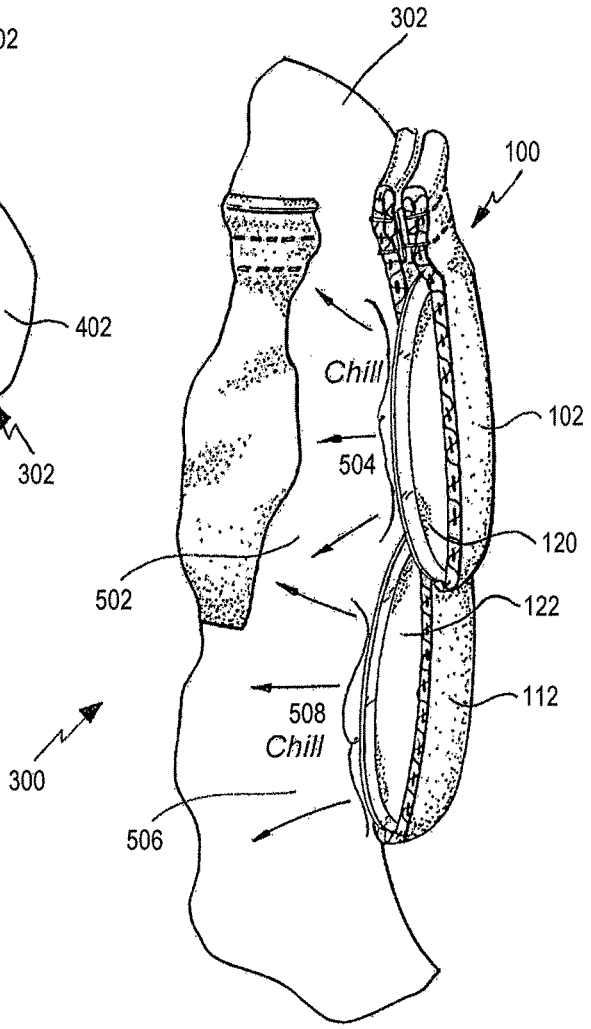
FIG. 5 illustrates an exploded cross-sectional view of the example athletic headband illustrated in FIG. 3, providing cooling to a portion of the user's head and a portion of the user's neck.

FIG. 5 illustrates an exploded cross-sectional view along line 5-5 of the example athletic headband illustrated in FIG. 4, providing cooling to a portion 502 of the user's head and a portion 506 of the user's neck.

As illustrated, the cooling element 120 is retained in the pocket 102 of the athletic headband 100 and generally conforms to a portion 502 of the head of the user 300, providing cooling 504 to the portion 502 of the user's head.

The cooling element 122 is retained in the pocket 112 of the athletic headband 100 and generally conforms to a portion 506 of the user's neck. The cooling element 120 in the pocket 102 overlaps at least partially the cooling element 122 in the pocket 112, pressing the cooling element 122 into the portion 506 of the user's neck to provide effective contact and cooling 508 to the portion 506 of the user 300.

Figure 6:
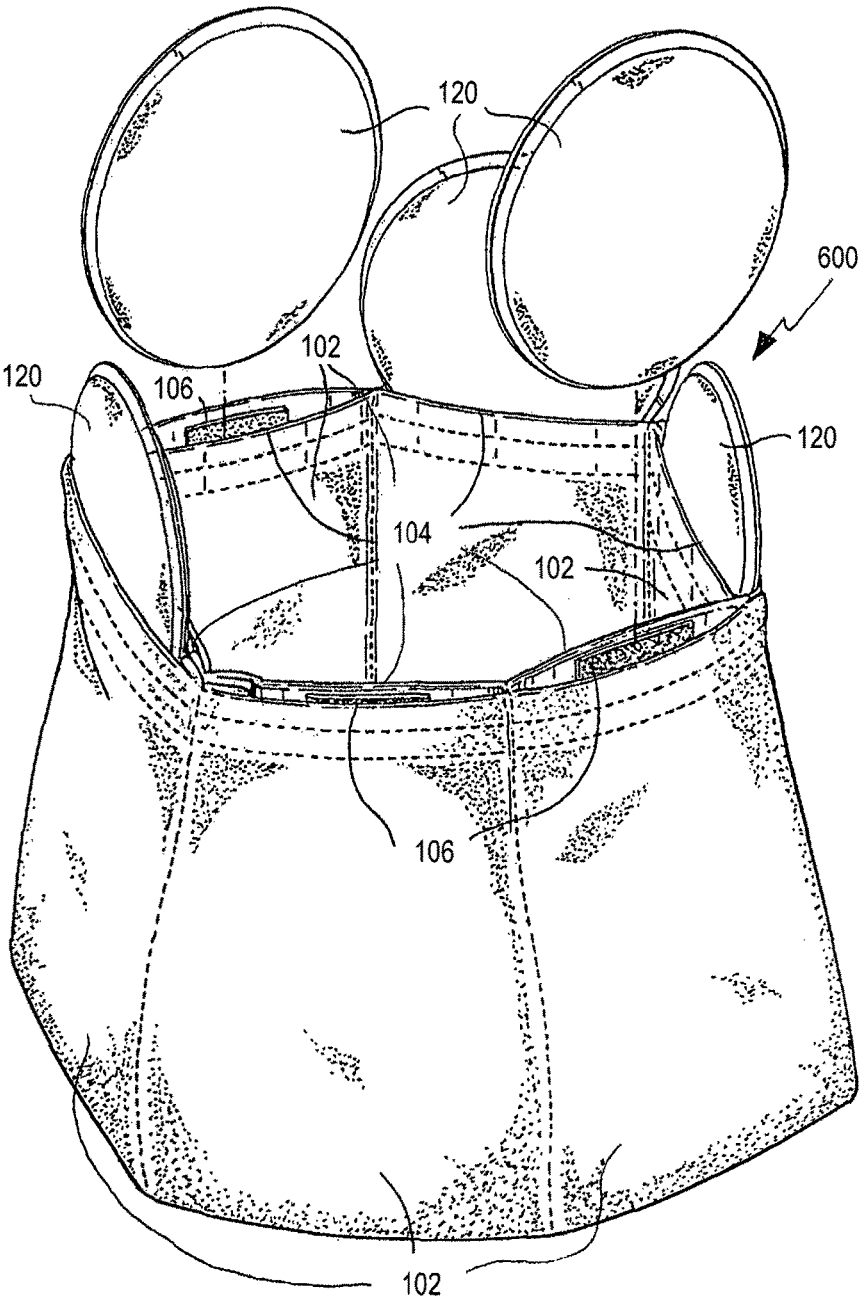
FIG. 6 illustrates a perspective view of an example athletic headband with removable cooling elements according to a second example embodiment.

FIG. 6 illustrates a perspective view of an example athletic headband 600 with removable cooling elements 120 according to a second example embodiment. The athletic headband 600 is similar to the athletic headband 100 described with reference to FIGS. 1-5, except that the dropdown pocket 112 is omitted from the athletic headband 600.

As such, the athletic headband 600 is configured to provide a combination of cooling and comfort. The athletic headband 600 provides removable cooling elements 120 for cooling the head of the user, as well as a stretchable circumference for disposing the headband 100 atop the head of the user and for holding the cooling elements 120 to provide improved use and comfort to the user.

Similarly, the athletic headband 600 is configured to fit precisely over a user's head, providing effective cooling to the user during and/or after athletic activity in which the user engages. The cooling reduces overheating and decreases the likelihood of heat stress and/or heatstroke, which can result from exercise and/or ambient temperature/humidity.

Thus, an athletic headband with removable cooling elements has been described. Although specific example embodiments have been described, it will be evident that various modifications and changes may be made to these embodiments without departing from the broader spirit and scope of the invention.

Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments shown are described in sufficient detail to enable those skilled in the art to practice the teachings disclosed herein. Other embodiments may be utilized and derived therefrom, such that structural and logical substitutions and changes may be made without departing from the scope of this application.

The foregoing detailed description, therefore, is not to be taken in a limiting sense, and the scope of various embodiments is defined only by the appended claims, along with the full range of equivalents to which such claims are entitled.

Although specific embodiments have been shown and described herein, it should be appreciated that any arrangement calculated to achieve the same purpose may be substituted for the specific embodiments shown. This application is intended to cover any and all adaptations or variations of various embodiments. Combinations of the above embodiments and other embodiments not specifically described herein will be apparent to those of skill in the art upon reviewing the above description.

The Abstract is provided to comply with 37 C.F.R. § 1.72(b) and will allow the reader to quickly ascertain the nature of the technical disclosure of this application. It is submitted with the understanding that it will not be used to interpret or limit the scope or meaning of the claims.

In the foregoing detailed description, various features may be grouped together in a single embodiment for the purpose of streamlining the disclosure of this application. This method of disclosure is not to be interpreted as reflecting that the claimed embodiments have more features than are expressly recited in each claim. Rather, as the following claims reflect, inventive subject matter lies in less than all features of a single disclosed embodiment.

Moreover, it is contemplated that the features or components of various embodiments described herein can be combined into different combinations that are not explicitly enumerated in the foregoing detailed description and that such combinations can similarly stand on their own as separate example embodiments that can be claimed.

The invention claimed is:

1. An athletic headband, the headband comprising:

a body having a first opening and a second opening substantially opposed to the first opening, the body configured to fit a head of a user through the first opening, the body including a plurality of pockets disposed about the body between the first opening to the second opening, the plurality of pockets having a respective plurality of openings;

a plurality of first cooling elements configured to be received into the plurality of pockets through the respective plurality of openings to provide cooling about the head of the user;

a dropdown pocket secured to an interior of the body between the first opening and the second opening, the dropdown pocket extending from the interior of the body below the body and having an opening; and a second cooling element configured to be received into the dropdown pocket through the opening, wherein a first cooling element to be received in a pocket of the body overlaps at least partially the second cooling element to be received in the dropdown pocket so that the first cooling element is configured to press the second cooling element into a neck of the user to provide cooling to the neck.

2. The athletic headband of claim 1, wherein a pocket of the plurality of pockets is defined by side stitchings extending between about the first opening and about the second opening.

3. The athletic headband of claim 1, wherein the body is stretchable.

4. The athletic headband of claim 1, wherein a pocket of the plurality of pockets comprises a retaining device to releaseably close the pocket.

5. The athletic headband of claim 1, wherein a cooling element of the plurality of first cooling elements comprises a shell and a fill material, the fill material enabled to provide cooling.

6. The athletic headband of claim 5, wherein the fill material is a gel or water, cooled to provide cooling.

7. The athletic headband of claim 5, wherein the fill material comprises components capable of providing cooling via an endothermic reaction.

8. The athletic headband of claim 1, wherein the plurality of first cooling elements is disposed adjacently to one another about the body.

9. The athletic headband of claim 1, wherein the plurality of first cooling elements provides continuous cooling about the head.

10. The athletic headband of claim 1, wherein a pocket of the plurality of pockets comprises an opening about the second opening of the body.

11. The athletic headband of claim 1, wherein the opening of the dropdown pocket is between the first opening and the second opening.

12. The athletic headband of claim 1, wherein the second cooling element is approximately the same as the first cooling element.

13. The athletic headband of claim 1, wherein the second cooling element is larger than the first cooling element.

14. The athletic headband of claim 1, wherein the dropdown pocket is stitched to the body generally along stitchings that define a pocket of the plurality of pockets disposed about the body.

15. The athletic headband of claim 1, wherein the dropdown pocket has a generally arcuate bottom.

16. The athletic headband of claim 1, wherein the dropdown pocket is stretchable.

17. The athletic headband of claim 1, wherein the dropdown pocket includes a retaining device to releaseably close the dropdown pocket.

18. The athletic headband of claim 1, wherein the second cooling element comprises a shell and a fill material, the fill material enabled to provide cooling.

19. The athletic headband of claim 18, wherein the fill material is a gel or water, cooled to provide cooling.

20. The athletic headband of claim 18, wherein the fill material comprises components capable of providing cooling via an endothermic reaction.

* * * * *